US005839929A

United States Patent [19]

Cousins

[11] Patent Number: 5,839,929

[45] Date of Patent: Nov. 24, 1998

[54] PROTECTION DEVICE FOR THE LOWER GEAR HOUSING OF A BOAT MOTOR

[76] Inventor: Gerald M. Cousins, Box 3000, Lac du Bonnet, Manitoba, Canada, R0E 1A0

[21] Appl. No.: 9,189

[22] Filed: Jan. 20, 1998

[51] Int. Cl.[6] ..... B63H 5/16

[52] U.S. Cl. ..... 440/76; 440/900

[58] Field of Search ..... 123/195 P; 440/53, 440/71, 72, 76, 900

[56] References Cited

U.S. PATENT DOCUMENTS

| | | | |
|---|---|---|---|
| 4,680,017 | 7/1987 | Eller | 440/71 |
| 4,925,412 | 5/1990 | Karls | 440/71 |
| 5,018,997 | 5/1991 | Guptill | 440/76 |
| 5,178,565 | 1/1993 | Jacobson . | |

*Primary Examiner*—Ed L. Swinehart
*Attorney, Agent, or Firm*—Adrian D. Battison; Murray E. Thrift

[57] ABSTRACT

A protection bar for the front edge of the lower housing portion of a drive housing of the boat motor comprises an elongate bar with a grooved rear edge friction fit on the front edge of the housing and the front edge of the scag plate. The top end of the bar is bolted to the flange coupling between the upper and lower housing portions. The lower end is bolted to the scag plate by a pair of side mounting plates and a cross bolt. The bar follows the shape of the front edges of the housing and the scag plate. The protection bar absorbs impacts to prevent damage to the cast housing portions.

11 Claims, 7 Drawing Sheets

PROTECTION DEVICE FOR THE LOWER GEAR HOUSING OF A BOAT MOTOR

This invention relates to a protective bar for mounting on the front edge of the lower housing portion of the gear housing of a boat motor.

BACKGROUND OF THE INVENTION

Conventionally a boat motor which can be either an inboard motor or an outboard motor includes a drive assembly communicating from the motor to the propeller. The drive assembly includes a housing which locates the drive shaft, the gearing adjacent the propeller itself. The housing is divided into an upper housing portion containing the drive shaft and located above the propeller together with a lower housing portion which mounts the gearing and the propeller. The lower housing portion also carries a cavitator plate above the propeller. A scag plate is mounted underneath the propeller lying in a vertical plane longitudinal of the axis of the propeller. The lower housing portion is attached to the upper housing portion by an upper flange which is bolted to a bottom flange of the upper housing portion. In the case of an outboard motor, the upper housing portion carries the motor and is attached externally of the transom. In an inboard arrangement, the upper housing portion is attached to the transom adjacent the lower edge.

As the lower housing portion projects downwardly from the underside of the boat, it is exposed for impact with rocks and other materials in the event that the boat passes over an area which is too shallow. In many cases the system allows a tripping action so that the lower housing can pivot to release the pressure on impact. However in many cases the impact is sufficient to crack or damage the lower housing leading to expensive repairs.

In U.S. Pat. No. 5,178,565 (Jacobson) issued Jan. 12, 1993, there is shown a protective bar which mounts on the front edge of the lower housing portion and the scag plate. This device is relatively complex and heavy and defines a lower pocket which contains the scag plate with a pair of wings at the bottom edge of the pocket. From the front edge of the scag plate, the bar extends upwardly and forwardly to a forward edge forward of the front edge of the housing. At the forward end is located a pair of pivotal arms which extend rearwardly. In practice these are bolted to the cavitator plate on each side of the housing. In order to attach the arms to the cavitator plate, bolts holes must be drilled and these can weaken the structure with the possibility of damage.

The device is therefore relatively heavy and cumbersome. In addition the relatively large side arms which extend to the cavitator plates can interfere with the proper flow of water across the side of the housing which may cause cavitation in the area of the side of the housing particularly at the intake for cooling water.

SUMMARY OF THE INVENTION

It is one object of the present invention, therefore to provide a protective bar which is simple in construction and yet can be effectively and safely attached to the housing.

According to one aspect of the invention there is provided a housing protection member for use with a gear housing of a boat motor and propeller drive assembly comprising:

an upper housing portion containing a drive shaft;

a lower housing portion containing a gear assembly and mounting a propeller;

the upper housing portion having a substantially horizontal bottom mounting flange;

the lower housing portion having a substantially horizontal top mounting flange bolted to the bottom mounting flange;

the lower housing portion having a bottom vertical scag plate underneath the propeller and extending downwardly therefrom in a plane longitudinal of an axis of the propeller to a bottom apex, the scag plate having a front edge;

the lower housing portion having a front edge lying in the plane of the scag plate substantially contiguous with the front edge thereof and extending from the scag plate substantially to the upper mounting flange;

the housing protection member comprising:

an elongate rigid protection bar arranged to lie in the plane of the front edge forwardly of the front edge and having a rear bar edge arranged to engage the front edge of the lower housing portion and the scag plate and a front bar edge extending forwardly therefrom;

a top mounting plate rigidly attached to and extending rearwardly from the bar for engaging one or both of the top and the bottom mounting flanges, the top plate having at least one bolt hole for attachment to the bolts connecting the top and bottom mounting flanges to hold the top plate in place;

and a pair of side mounting plates rigidly attached to and extending rearwardly from the bar at the scag plate for engaging respective sides of the scag plate for attachment thereto.

Preferably the top plate includes a pair of arms each extending around a respective side of the housing for engaging a bottom surface of the top flange.

Preferably the top plate includes an upper plate portion having a single center bolt hole for engaging and bolting to an upper surface of the bottom flange and a lower engagement portion for engaging the housing below the top flange for locating the top plate to prevent side to side movement.

Preferably the side mounting plates extend to a position only partly across the scag plate and are bolted to the scag plate by a bolt passing through the side mounting plates and the scag plate.

Preferably the bar is attached to the housing only by the top plate and the side mounting plates.

Preferably the bar is arranged to be in contact with the front edge of the lower housing portion and the scag plate substantially wholly along the whole length thereof.

Preferably the member consists solely of the bar, the top plate and the side mounting plates Preferably the rear edge of the bar includes a groove therein for receiving the front edge of the housing and the scag plate.

Preferably the groove is V-shaped in cross-section.

Preferably a portion of the groove of the rear edge at the front edge of the housing is V-shaped in cross-section with two converging sides and a base so as to frictionally engaged onto the front edge of the housing and wherein a portion of the groove of the rear edge at the scag plate is of rectangular shape in cross-section.

Preferably the engagement between the groove and the front edge prevents relative movement of the bar and the front edge.

BRIEF DESCRIPTION OF THE DRAWINGS

One embodiment of the invention will now be described in conjunction with the accompanying drawings in which.

DETAILED DESCRIPTION

Figure 1:
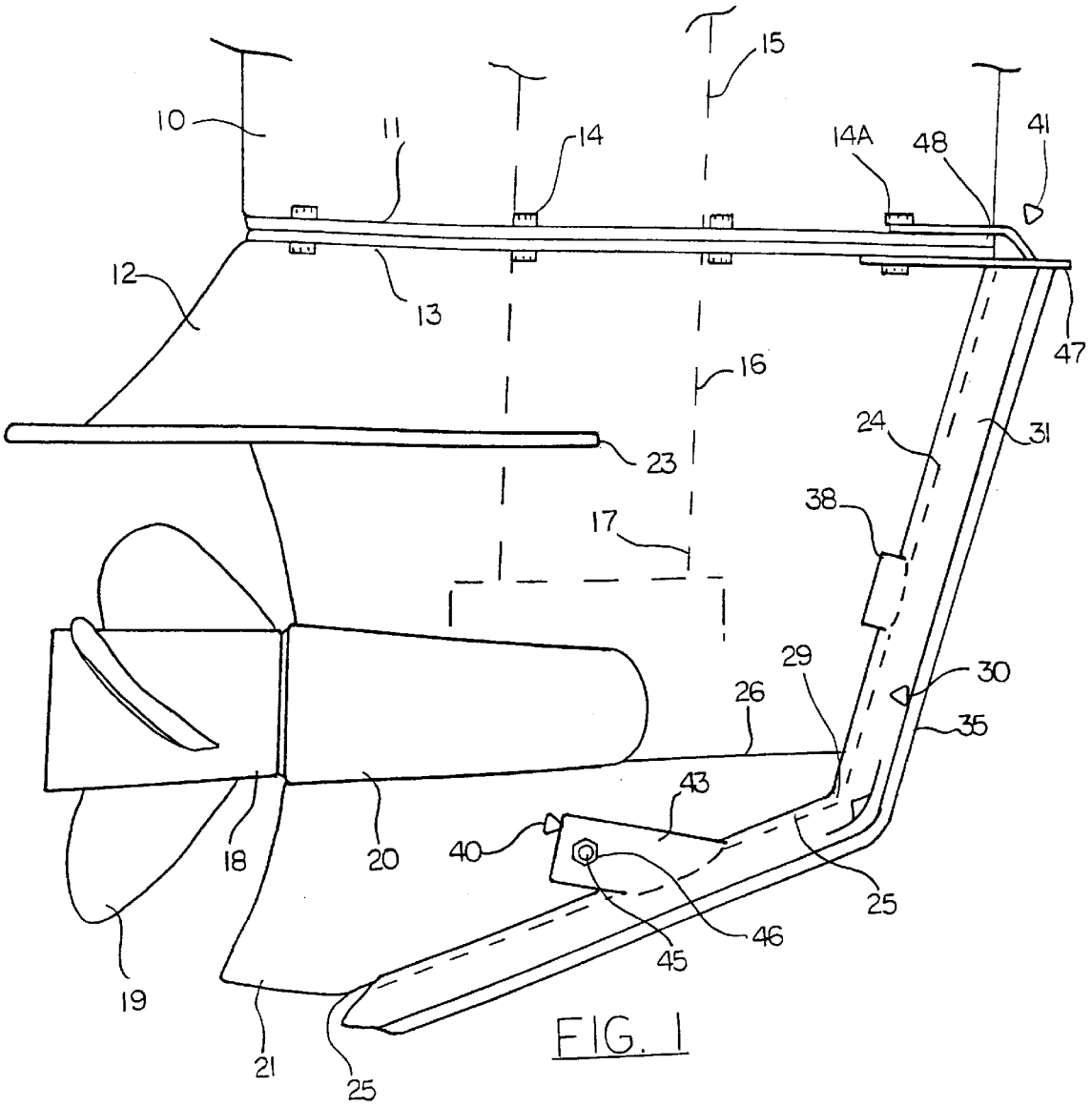
FIG. 1 is a side elevational view of an outboard motor with a protection device according to the present invention attached.
Figure 2:
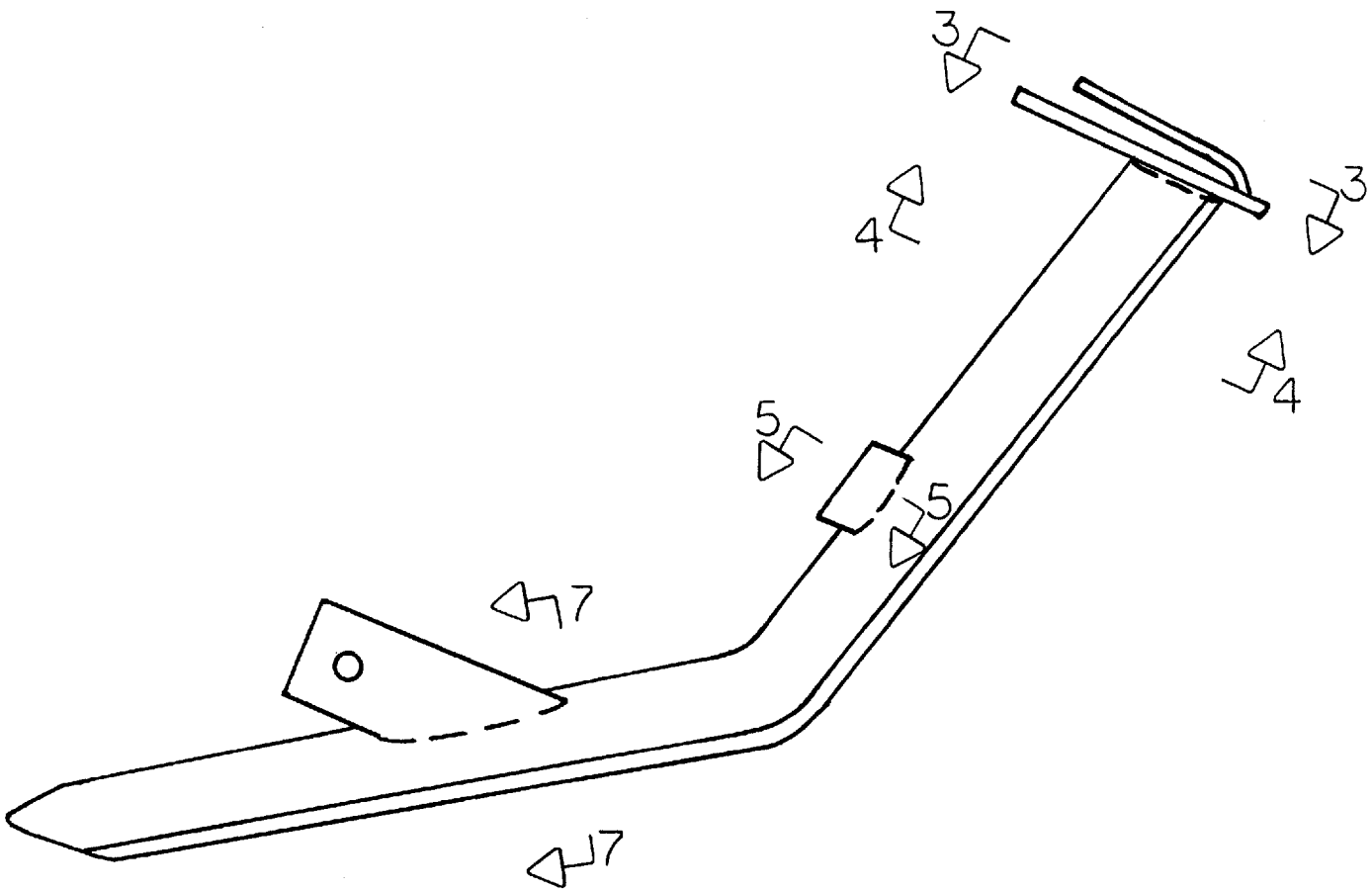
FIG. 2 is a side elevational view of the protection device according to the present invention alone.
Figure 3:
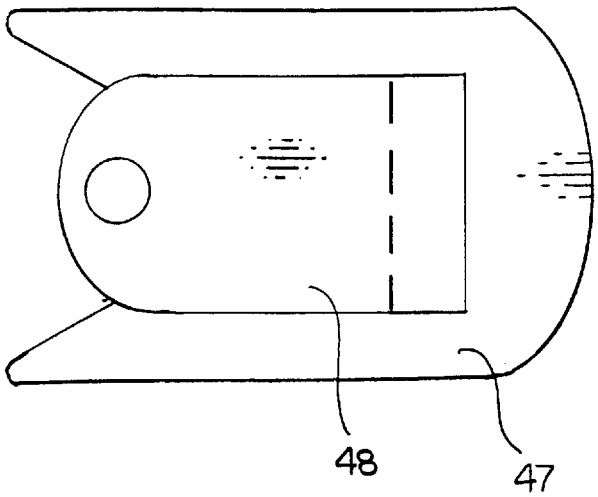
FIG. 3 is a view along the lines 3—3 of FIG. 2.

A lower portion of an outboard motor of a conventional type is shown in FIG. 1. This includes an upper housing portion 10 which has a bottom flange 11 and a lower housing portion 12 which has an upper flange 13. The flanges 11 and 13 surround the exterior of the housing and overlie so that they can be bolted together by a series of bolts 14 passing through aligned holes in the flanges.

The upper housing contains a drive system schematically indicated at 15 which connects to a lower drive system 16 in the lower housing which in turn connects to a gear coupling 17 for driving a shaft 18 and a propeller 19. The shaft 18 is mounted within a bulbous portion 20 of the housing. Below the bulbous housing portion 20 is mounted a scag plate 21 which simply forms a vertical flat plate at the base of the lower housing.

Underneath the upper flange 13 and generally parallel to the flange 13 is provided a cavitator plate 22 which is mounted above the propeller and projects rearwardly out of the housing to define a horizontal surface under which the propeller operates. The cavitator plate extends forwardly from the housing to a front edge 23 spaced rearwardly of the front edge of the housing.

The housing is relatively narrow and converges to a vertical front edge which extends downwardly from the front of the upper flange 13 in a first edge portion 24 which is inclined downwardly and rearwardly at a relatively shallow angle and in a second edge portion 25 which is inclined downwardly and rearwardly at a sharper angle to a horizontal bottom edge 25 of the scag plate. The scag plate extends forwardly to the front edge 25 and the housing converges downwardly and inwardly to a top edge 26 of the scag plate.

Outboard motors are generally of the construction described above and these are of course conventional and well known. The present invention relates to construction of the protection device described hereinafter.

The protection device is provided to provide a rigid front edge of the lower housing so as to prevent impacts of the lower housing with an obstacle from cracking the housing. The protection device therefore provides sufficient impact resistance to allow the tripping action of the motor to occur while reducing or eliminating the possibility of damage to the lower housing.

Figure 4:
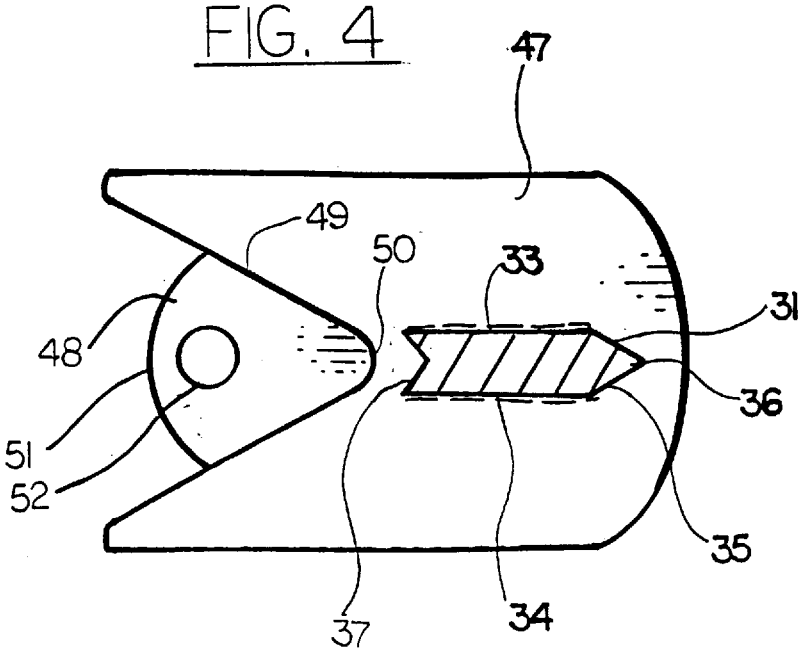
FIG. 4 is a cross-sectional view along the lines 4—4 of FIG. 2.

The protection device comprises an elongate rigid protection bar generally indicated at 30 including an upper portion 31 and a lower portion 32. The upper portions 31 is arranged at an angle A relative to the lower portion with the angle A matching that of the angle between the front edge portions 24 and 25 of the housing. Each of the portions 31 and 32 is formed from a thin bar or strip of metal which is solid and has parallel sides 33 and 34 as best shown in FIG. 4. A front edge 35 is sharpened to a front apex 36 centrally of the sides 33 and 34. The rear edge is shaped to form a V shaped recess 37 generally matching the front edge of the housing.

The portion 31 extends from the bottom edge of the upper flange 13 to the apex 29 between the portions 24 and 25 of the housing. The lower portion 32 extends from the apex 29 to the bottom edge 25 of the scag plate and can extend slightly beyond that. The portions 31 and 32 are straight.

Figure 5:
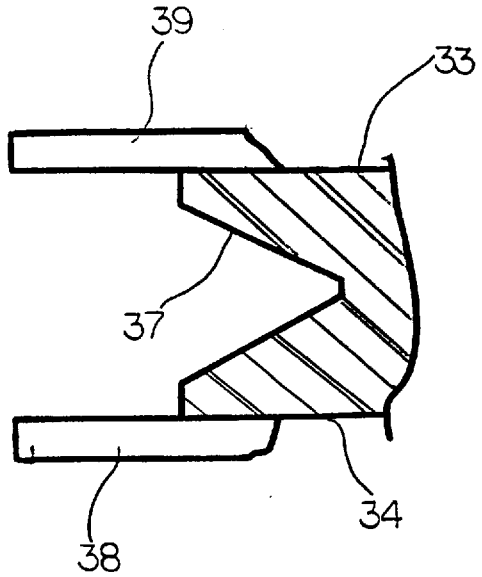
FIG. 5 is a cross-sectional view along the lines 5—5 of FIG. 2.

On each side of the portion 31 is mounted a pair of tabs 38, 39 best shown in FIG. 5. These tabs are arranged to engage loosely against the respective sides of the housing so as to tend to hold the protective bar in place in front of the housing.

The protective bar is attached to the housing by a bottom mounting bracket 40 and a top mounting bracket 41.

The bottom mounting bracket comprises a pair of plates 42 each welded on a respective side 33, 34 of the protective bar. Thus each extends along a respective side of the scag plate 21. A hole is drilled through the scag plate which is aligned with holes 44 in the plates 42 and 43 so as to allow a bolt 45 to pass through the holes and be attached by a nut 46 holding the bolt in plate. The plates 42 and 43 are arranged at an angle to the bottom portions 32 at a position spaced upwardly from the bottom edge so as to underlie the bulbous housing portion 20 and at the top of the scag plate. The plates 42 and 43 extend rearwardly over the scag plates sufficiently only to provide rigid attachment and to provide sufficient length to prevent twisting of the protective bar in a side to side direction which could cause cracking of the scag plate if insufficient length of the scag plate is held between the plates 42 and 43 in clamped position.

Figure 7:
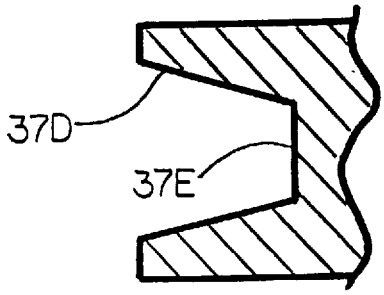
FIG. 7 is a cross-sectional view along the lines 7—7 of FIG. 2.

As shown in FIG. 7, the recess portion 37A of the recess 37 and the scag plate is shaped so it has parallel sides 37B and 37C which match the parallel sides of the scag plate as a friction fit.

The top mounting bracket 41 includes a horizontal main mounting plate 47 and a top plate 48 attached to the plate 47 at a forward end thereof and extending rearwardly therefrom while being counted slightly upwardly therefrom so that the rear part of the top plate 48 is generally parallel to the main plate 47. The main plate 47 has a rear edge 49 which is cut into a V shape with a forward apex 50 and two diverging sides. These are shaped to grip around the front edge of the housing immediately underneath the upper flange 13. The top plate 48 extends over the main plate 47 to a rear edge 51 positioned over the recessed V shaped area of the main plate. The top plate 48 has a hole 52 centrally thereof adjacent the rear edge which is located to correspond to the position of a front central bolt 14A connecting the flanges 11 and 13.

In this arrangement therefore, the top bracket 41 is attached to the flanges 11 and 13 by a single bolt 14A positioned centrally of the top plate 48. The protective bar is prevented from twisting side to side at the bracket 41 by the V shape recess 49 which grasps the front part of the housing underneath the flange 13.

Figure 6:
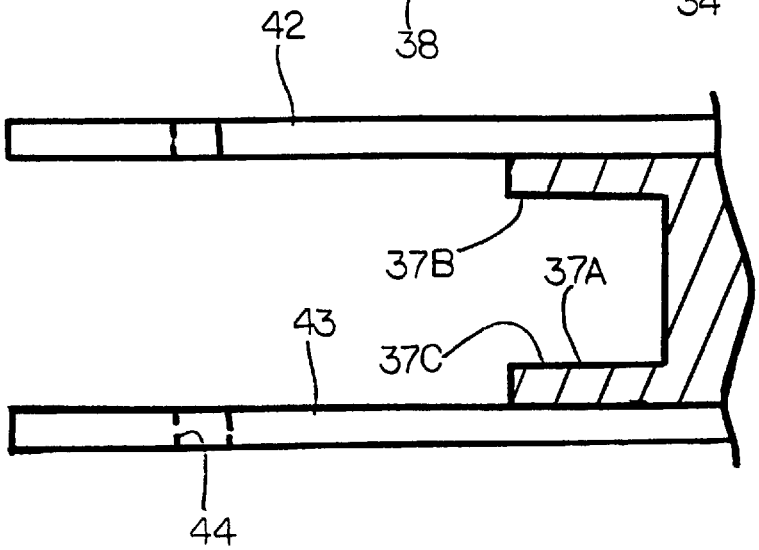
FIG. 6 is a cross-sectional view similar to that of FIG. 5 showing a modified arrangement.

In FIG. 6 is shown a slightly modified arrangement in which the tabs 38 and 39 are omitted and the recess 37D is shaped with a wider base 37E so as to more accurately match the front edge of the housing. Whereas the recess 37 of FIG. 5 is merely V shaped so as to receive the front edge of the housing as a loose fit therein, the recess 37D of the modified arrangement of FIG. 6 is more carefully constructed so as to match the front edge of the housing as a friction fit to more rigidly hold the protective bar in place on the front of the housing without the necessity for the tabs 38 and 39.

Figure 8:
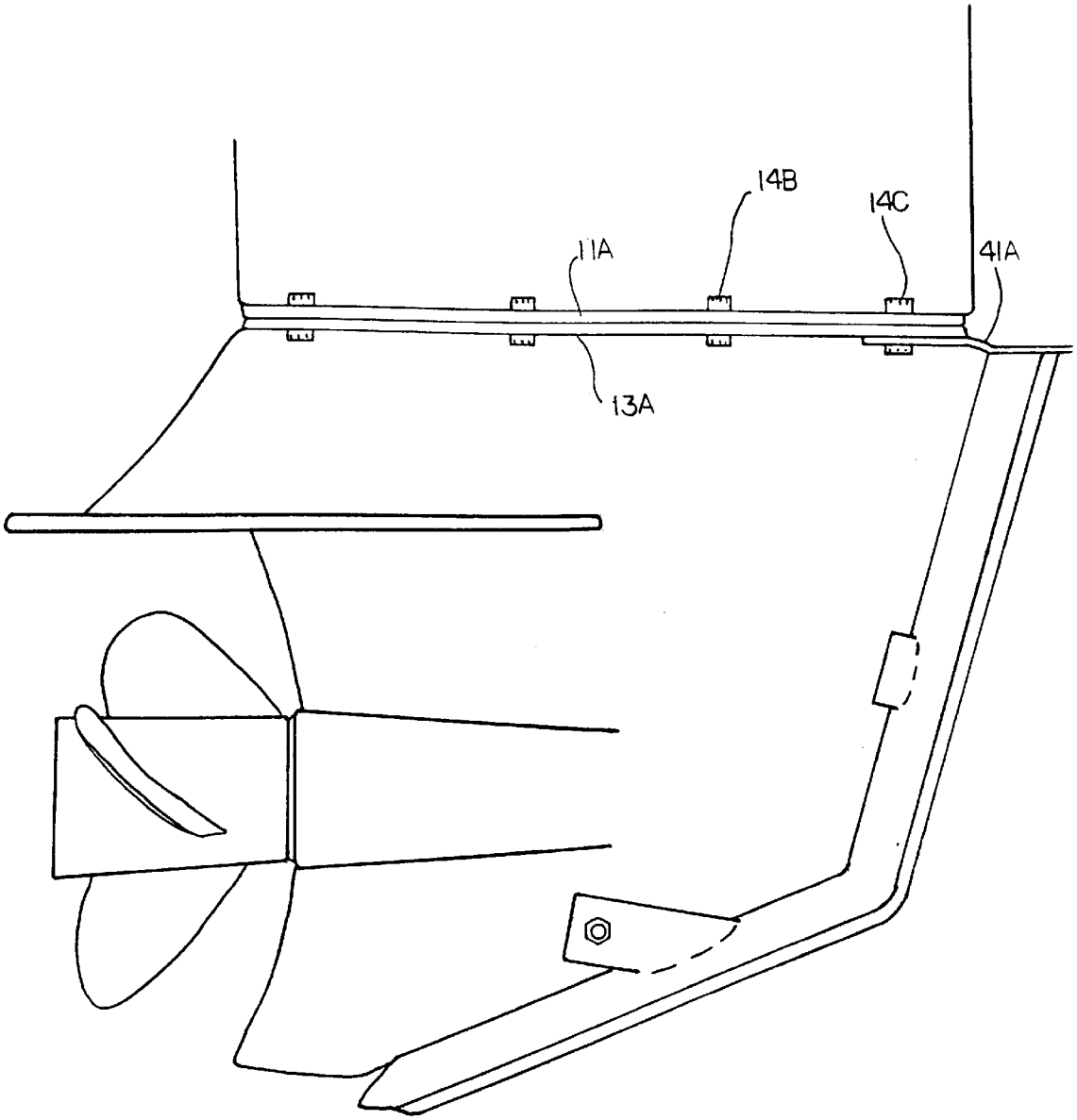
FIG. 8 is a side elevational view similar to that of FIG. 1 of a second embodiment of an outboard motor with a protection device according to the present invention attached.
Figure 9:
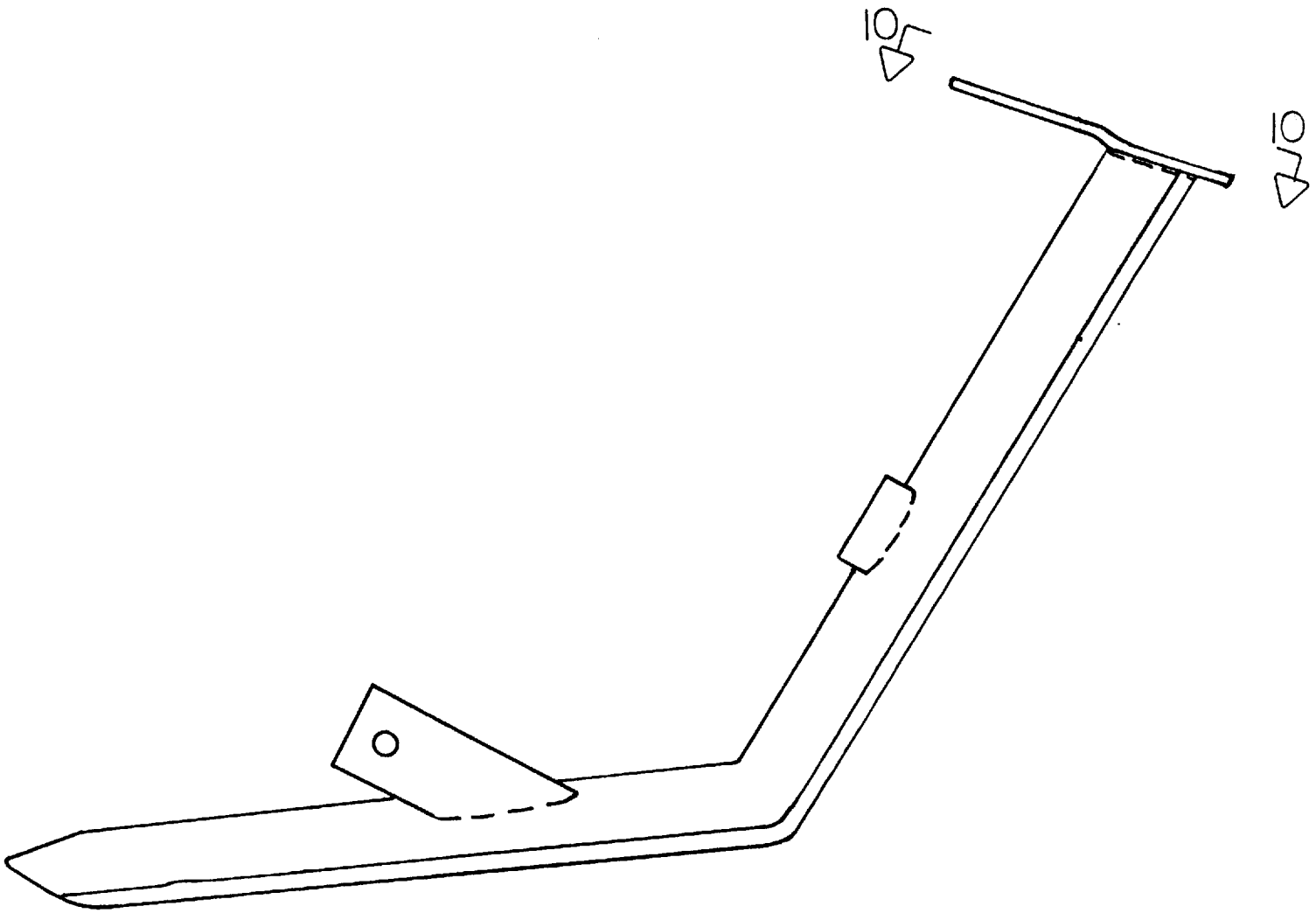
FIG. 9 is a side elevational view of the protection device of FIG. 8 according to the present invention alone.
Figure 10:
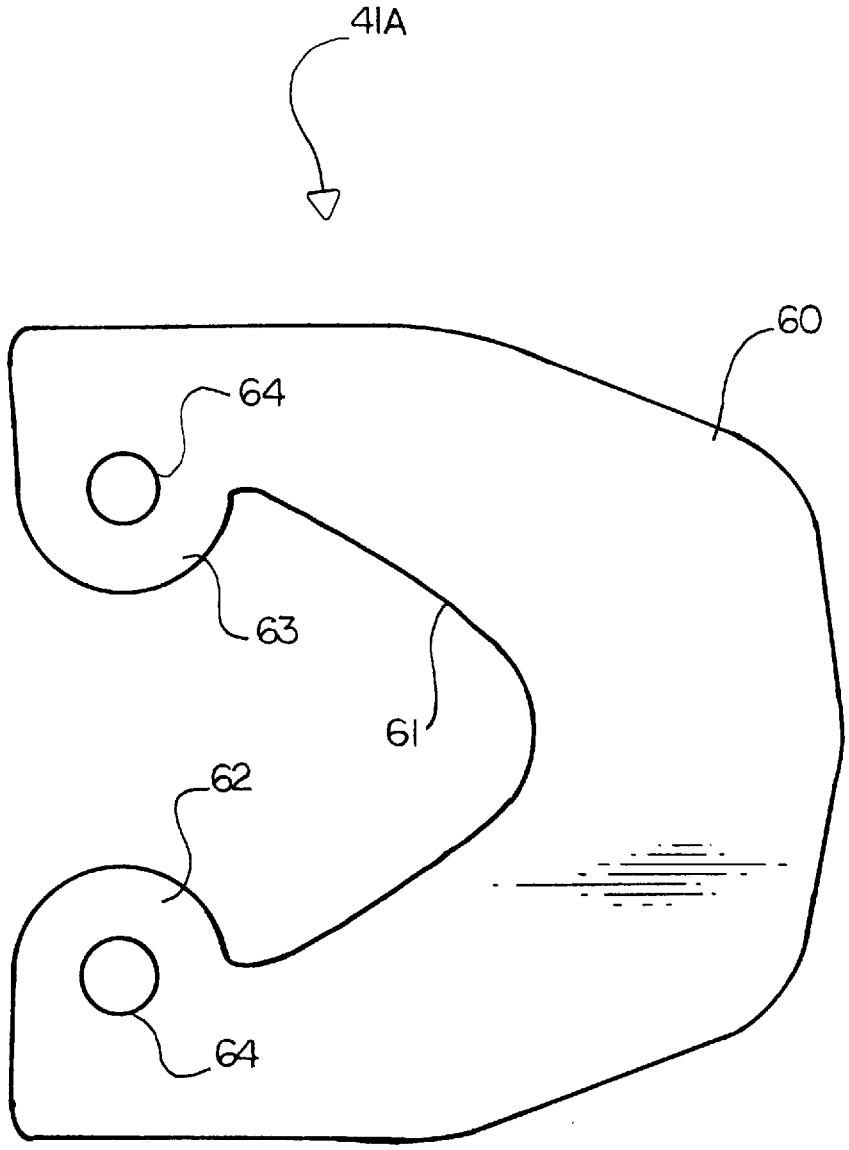
FIG. 10 is a top plan view of the top mounting plate of the embodiment of FIG. 8.

In FIGS. 8, 9 and 10 is shown a further modified arrangement which is suitable for a modified form of the outboard housing in which bolts 14B and 14C are used to connect the upper flange 13A to the bottom flange 11A. In this embodiment, instead of having a single central bolt, two bolts 14C are located each on a respective side of the front edge of the housing. In this embodiment, therefore, the top mounting bracket 41A comprises a single plate 60 with a rear edge 61 shaped to engage around the housing underneath the flange 13A and two inwardly projecting lugs 62 and 63 for engaging under the flange 13A. Each lug has a hole 64 for receiving a respective one of the bolts 14C. In this embodiment, as the mounting bracket 41A is rigidly bolted on two sides to the underside of the flange 13A, the mounting bracket provides the necessary resistance to twisting without the necessity for a top and bottom plate as previously described.

It will be appreciated that the shape and arrangement of the top mounting bracket can vary depending upon the specific construction of the flange 13A and the shape of the front of the housing. However the attachment of the top mounting bracket to the flange avoids the necessity for any further holes to be drilled in the housing or any projections which could interfere with the flow of water over the housing portion 20 and the cavitation plate.

The arrangement as described above can be used in addition with an inboard motor which generally has a bottom housing substantially identical to the bottom housing previously described in an upper flange 13 which connects to the bottom flange of the transmission housing of the inboard motor.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A housing protection member for use with a gear housing of a boat motor and propeller drive assembly comprising:

an upper housing portion containing a drive shaft;

a lower housing portion containing a gear assembly and mounting a propeller;

the upper housing portion having a substantially horizontal bottom mounting flange;

the lower housing portion having a substantially horizontal top mounting flange bolted to the bottom mounting flange;

the lower housing portion having a bottom vertical scag plate underneath the propeller and extending downwardly therefrom in a plane longitudinal of an axis of the propeller to a bottom apex, the scag plate having a front edge;

the lower housing portion having a front edge lying in the plane of the scag plate substantially contiguous with the front edge thereof and extending from the scag plate substantially to the upper mounting flange;

the housing protection member comprising:

an elongate rigid protection bar arranged to lie in the plane of the front edge forwardly of the front edge and having a rear bar edge arranged to engage the front edge of the lower housing portion and the scag plate and a front bar edge extending forwardly therefrom;

a top mounting plate rigidly attached to and extending rearwardly from the bar for engaging one or both of the top and the bottom mounting flanges, the top plate having at least one bolt hole for attachment to the bolts connecting the top and bottom mounting flanges to hold the top plate in place;

and a pair of side mounting plates rigidly attached to and extending rearwardly from the bar at the scag plate for engaging respective sides of the scag plate for attachment thereto.

2. The member according to claim 1 wherein the top plate includes a pair of arms each extending around a respective side of the housing for engaging a bottom surface of the top flange.

3. The member according to claim 1 wherein the top plate includes an upper plate portion having a single center bolt hole for engaging and bolting to an upper surface of the bottom flange and a lower engagement portion for engaging the housing below the top flange for locating the top plate to prevent side to side movement.

4. The member according to claim 1 wherein the side mounting plates extend to a position only partly across the scag plate and are bolted to the scag plate by a bolt passing through the side mounting plates and the scag plate.

5. The member according to claim 4 wherein the bar is attached to the housing only by the top plate and the side mounting plates.

6. The member according to claim 1 wherein the bar is arranged to be in contact with the front edge of the lower housing portion and the scag plate substantially wholly along the whole length thereof.

7. The member according to claim 6 wherein the member consists solely of the bar, the top plate and the side mounting plates.

8. The member according to claim 1 wherein the rear edge of the bar includes a groove therein for receiving the front edge of the housing and the scag plate.

9. The member according to claim 8 wherein the groove is V-shaped in cross-section.

10. The member according to claim 9 wherein a portion of the groove of the rear edge at the front edge of the housing is V-shaped in cross-section with two converging sides and a base so as to frictionally engaged onto the front edge of the housing and wherein a portion of the groove of the rear edge at the scag plate is of rectangular shape in cross-section.

11. The member according to claim 10 wherein the engagement between the groove and the front edge prevents relative movement of the bar and the front edge.

* * * * *